US009091452B2

(12) United States Patent
Yen

(10) Patent No.: US 9,091,452 B2
(45) Date of Patent: Jul. 28, 2015

(54) MISTING FAN

(71) Applicant: Yu-Chi Yen, Changhua County (TW)

(72) Inventor: Yu-Chi Yen, Changhua County (TW)

( * ) Notice: Subject to any disclaimer, the term of this patent is extended or adjusted under 35 U.S.C. 154(b) by 408 days.

(21) Appl. No.: 13/676,097

(22) Filed: Nov. 14, 2012

(65) Prior Publication Data

US 2014/0131901 A1 May 15, 2014

(51) Int. Cl.
*F24F 6/12* (2006.01)
*F04D 29/70* (2006.01)
*F04D 19/00* (2006.01)

(52) U.S. Cl.
CPC ..... *F24F 6/12* (2013.01); *F04D 19/002* (2013.01); *F04D 29/705* (2013.01)

(58) Field of Classification Search
CPC ..... F24F 6/12; F24F 6/16; Y10S 416/02; F04D 29/542
USPC ..... 261/78.1
See application file for complete search history.

(56) References Cited

U.S. PATENT DOCUMENTS 1,658,438 A * 2/1928 Hall ..... 416/220 R
1,722,112 A * 7/1929 Robinson ..... 416/182
2,023,111 A * 12/1935 Alsing ..... 416/144
2,063,921 A * 12/1936 Gray ..... 261/29
2,212,041 A * 8/1940 Pfautsch ..... 416/238
2,238,120 A * 4/1941 Launder ..... 239/77
2,259,853 A * 10/1941 Koch ..... 416/247 R
2,639,940 A * 5/1953 Fish ..... 239/78
2,995,191 A * 8/1961 Radcliffe ..... 416/242
3,188,007 A * 6/1965 Myklebust ..... 239/215
3,221,993 A * 12/1965 Bals ..... 239/77
3,296,739 A * 1/1967 Wiegel ..... 47/2
3,963,382 A * 6/1976 Patton ..... 417/361
4,737,077 A * 4/1988 Vera ..... 416/242
5,180,106 A * 1/1993 Handfield ..... 239/14.2
5,393,199 A * 2/1995 Alizadeh ..... 416/189
6,086,053 A * 7/2000 Natschke et al. ..... 261/30
6,183,204 B1 * 2/2001 Chang ..... 416/246
6,257,502 B1 * 7/2001 Hanish et al. ..... 239/290
6,350,104 B1 * 2/2002 Moreau et al. ..... 416/192

(Continued)

FOREIGN PATENT DOCUMENTS

DE 102009039634 * 3/2011
DE 102009039634 A1 * 3/2011

(Continued)

OTHER PUBLICATIONS

EPO and Google translation of Niebuhr DE 10 2009 039 634 A1 published Mar. 17, 2011.*

*Primary Examiner* — Duane Smith
*Assistant Examiner* — Stephen Hobson

(57) ABSTRACT

A misting fan includes a body, a nebulizing member, a directing member and a fan member. The body has a motor, a sink and a plurality of channels defined thereon. The channels communicate with the sink. The nebulizing member is assembled on the body, corresponds to one side of the motor, and communicates with the channels. The fan member is assembled to the motor and is defined between the nebulizing member and the motor. The directing member is assembled on the body and is defined between the fan member and the nebulizing member. Under this arrangement, when a volume of water is delivered from the sink to the nebulizing member via the channels so as to eject mists, the gas flows are delivered to each directing portion to forwardly spread the mists outside.

9 Claims, 11 Drawing Sheets

(56) References Cited

U.S. PATENT DOCUMENTS

| | | | | |
|---|---|---|---|---|
| 6,394,766 | B1 * | 5/2002 | Gill et al. | 417/423.1 |
| 6,789,787 | B2 * | 9/2004 | Stutts | 261/28 |
| 6,997,682 | B2 * | 2/2006 | Jung et al. | 416/223 R |
| 7,395,676 | B2 * | 7/2008 | White | 62/310 |
| D680,209 | S * | 4/2013 | Yen | D23/370 |
| 2003/0206800 | A1 * | 11/2003 | Mathson et al. | 415/220 |
| 2004/0136830 | A1 * | 7/2004 | Eguchi et al. | 416/228 |
| 2008/0023857 | A1 * | 1/2008 | Dos Santos et al. | 261/83 |
| 2008/0267774 | A1 * | 10/2008 | Lian | 415/204 |
| 2009/0324413 | A1 * | 12/2009 | Streng et al. | 416/219 R |
| 2011/0036926 | A1 * | 2/2011 | Nunes | 239/214 |
| 2011/0163211 | A1 * | 7/2011 | Cicco | 248/158 |
| 2014/0165639 | A1 * | 6/2014 | Canipe et al. | 62/259.4 |

FOREIGN PATENT DOCUMENTS

| | | | |
|---|---|---|---|
| DE | 202012104519 | U1 * | 1/2013 |
| WO | WO 2013113083 | A1 * | 8/2013 |

* cited by examiner

MISTING FAN

BACKGROUND OF THE INVENTION

1. Field of the Invention

The present invention relates to a fan, and more particularly to a misting fan.

2. Description of Related Art

A conventional fan structure for ejecting mists comprises a fan body, a misting assembly, a pump and a water supplier, the fan body comprising a fan member and a motor, the pump assembled to the motor, the misting assembly assembled on the fan body and the pump, a misting member of the misting assembly being defined at a front side of the fan member, the water supplier assembled to the pump. Under this arrangement, when a user turn on a power of the conventional fan structure for ejecting mists, firstly a volume of water is pumped from the water supplier to the misting member by the pump; and then, water is converted to mists by the misting member; as a result, the mists are blown out to the environment by gas flows which are produced by the fan member so as to cool down the temperature of the environment.

However, the conventional fan structure for ejecting mists has disadvantages as following.

Firstly, because a net member of the body is an alternated-arranged network structure, when the gas flows impact on the net member of the body, some of the gas flows are moved back to the fan member and generate a voice; and only rest of the gas flows would blow out the mists, so that a flying distance of the mists is reduced.

Secondly, installing the conventional fan structure for ejecting mists is difficult, complicated and time wasting.

Thirdly, pumping water from the water supplier to the misting member is energy-costing.

The present invention has arisen to mitigate and/or obviate the disadvantages of the conventional.

SUMMARY OF THE INVENTION

The main objective of the present invention is to provide a mist fan.

To achieve the objective, a misting fan comprises a body, a nebulizing member, a directing member and a fan member, the body having a motor assembled therein, the body having a sink and a plurality of channels defined at an upper portion thereof, the channels communicating with the sink, the nebulizing member being assembled on the body, the nebulizing member corresponding to one side of the motor and communicating with the channels, the fan member being assembled to the motor, the fan member being defined between the nebulizing member and the motor, the directing member being assembled on the body, the directing member being defined between the fan member and the nebulizing member, the directing member corresponding to a direction of gas flows generated by the rotation of the fan member, the directing member comprising a plurality of directing portions, each directing portion comprising a first directing plane and a second directing plane, a first angle being defined between each first directing plane and each corresponding second directing plane, each first directing plane and each corresponding second directing plane corresponding to the fan member. Wherein, the fan member comprises a plurality of blades; the fan member has a first axial line and a second axial line extended from a center thereof toward one of the blades; an angle of fan member defined between the two axial lines is 38.47 degrees; a plane projection of each blade has a first radius, a second radius, a third radius and a fourth radius, which equal to 36.46 mm, 9.05 mm, 8.65 mm and 32.73 mm respectively; a side projection of each blade has an injecting portion and an ejecting portion defined thereon; the injecting portion has a fifth radius which equals to 69.23 mm; the ejecting portion has a sixth radius, a seventh radius and an eighth radius which are aligned in order from a center of the blade and equal to 162.48 mm, 31 mm and 12.28 mm respectively; a blade thickness is 2 mm; the first directing plane of each directing portion corresponds to the second directing plane of an adjacent directing portion; one angle is defined between the first directing plane and the second directing plane of each directing portion; the angle equals to 45 degrees; the directing portion has a horizontal line; another angle between the first directing plane of the directing portion and the horizontal line equals to 10 degrees; the other angle between the second directing plane of the directing portion and the horizontal line equals to 35 degrees; the body has a funnel assembled thereon; the funnel corresponds to an opening of the sink; the body comprises an ejecting member, an injecting member, a tank and a seat; a front side of the tank is assembled to the ejecting member and a rear side of the tank is assembled to the injecting member respectively; the tank is defined between an upper portion of the injecting member and another upper portion of the ejecting member; a bottom portion of the injecting member and another bottom portion of the ejecting member are assembled to the seat; the motor is assembled to the injecting member; the nebulizing member and the channels are assembled to the ejecting member; the directing portion of the directing member partially covers the channels; the tank comprises a front casing and a rear casing; the front casing is assembled with the rear casing; the front casing and the rear casing are both vaulted-shaped; the front casing and the rear casing enclose the sink; the seat has an assembling groove defined at a bottom thereof; the body further comprises a base which is assembled to the assembling groove; the ejecting member has a cap assembled thereon; the cap has an outlet opened thereon; the outlet corresponds to the nebulizing member so that the mists of the nebulizing member are spread outwardly from the outlet; the ejecting member has a plurality of annular ribs defined thereon; the annular ribs enclose the cap; a thickness of each annular rib is gradually decreased from the injecting member toward the ejecting member.

Under this arrangement, when a volume of water is delivered from the sink to the nebulizing member via the channels so as to eject mists, the gas flows generated by the rotation of the fan member are delivered via the first directing plane and the second directing plane of each directing portion so as to forwardly spread the mists outside.

Further benefits and advantages of the present invention will become apparent after a careful reading of the detailed description with appropriate reference to the accompanying drawings.

DETAILED DESCRIPTION OF THE INVENTION

Figure 1:
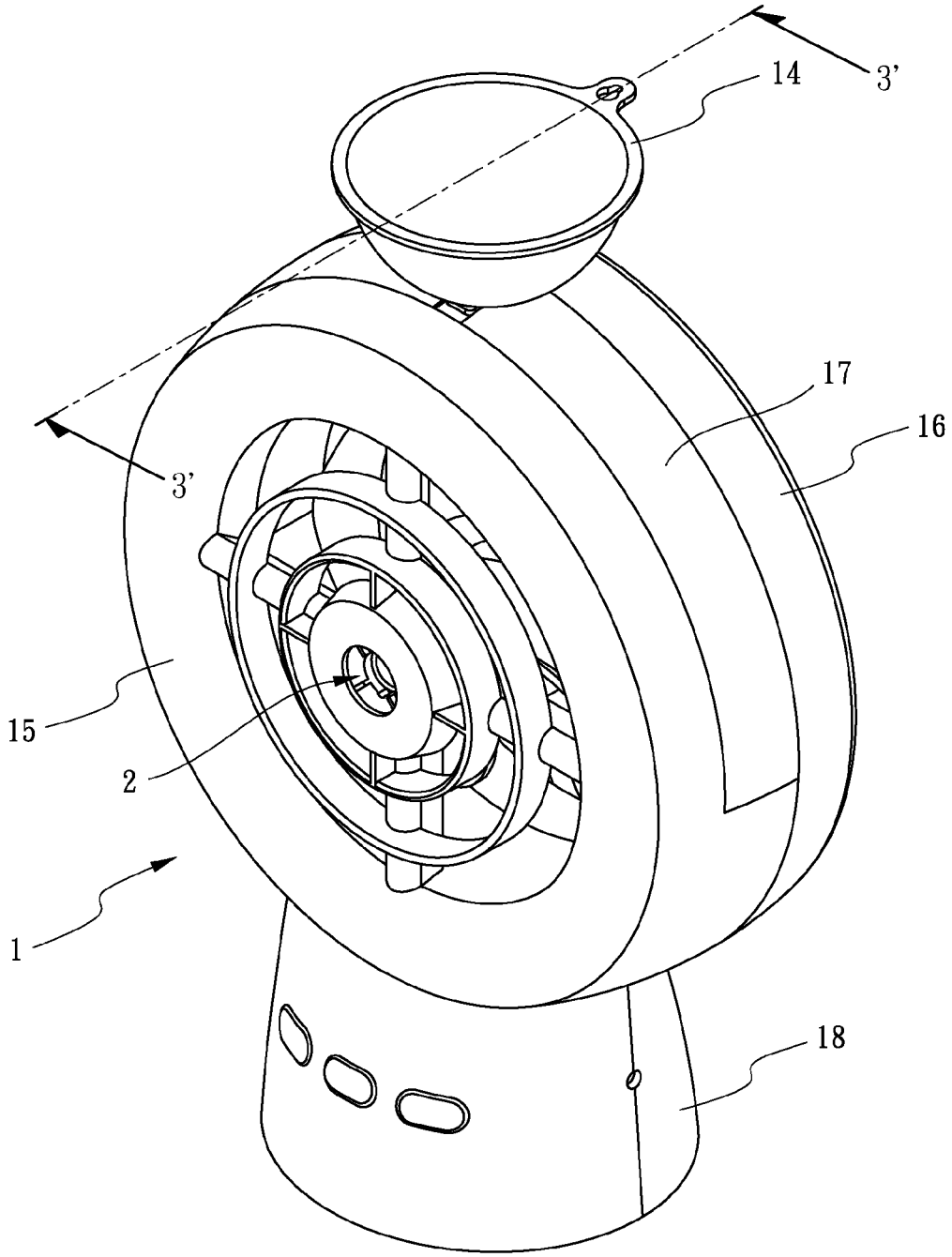
FIG. 1 is a perspective view of a misting fan of the present invention.

Referring to FIGS. 1-4, a misting fan in accordance with the present invention comprises a body 1, a nebulizing member 2, a directing member 3 and a fan member 4.

The body 1 has a motor 11 assembled therein. The body 1 has a sink 12 and a plurality of channels 13 defined at an upper portion thereof. The channels 13 communicate with the sink 12.

The nebulizing member 2 is assembled on the body 1. The nebulizing member 2 corresponds to one side of the motor 11 and communicates with the channels 13.

The fan member 4 is assembled to the motor 11. The fan member 4 is defined between the nebulizing member 2 and the motor 11.

Figure 5:
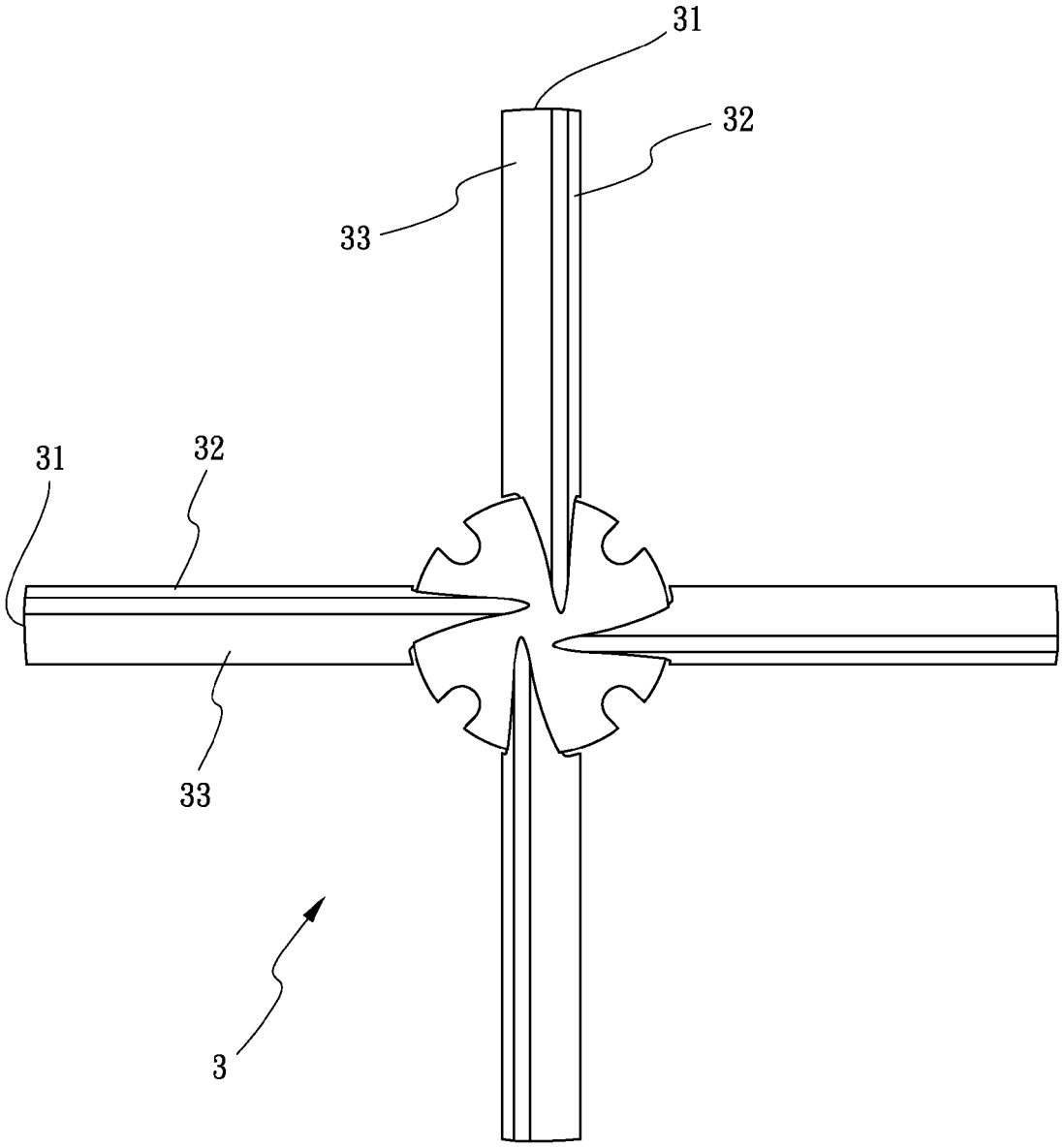
FIG. 5 is a plan view of the directing member of the misting fan.

The directing member 3 is assembled on the body 1. The directing member 3 is defined between the fan member 4 and the nebulizing member 2. The directing member 3 corresponds to a direction of gas flows generated by the rotation of the fan member 4. The directing member 3 comprises a plurality of directing portions 31. Each directing portion 31 comprises a first directing plane 32 and a second directing plane 33, as shown in FIG. 5. One angle X is defined between each first directing plane 32 and each corresponding second directing plane 33. Each first directing plane 32 and each corresponding second directing plane 33 corresponds to the fan member 4.

Under this arrangement, when a volume of water is delivered from the sink 12 to the nebulizing member 2 via the channels 13 so as to eject mists, the gas flows generated by the rotation of the fan member 4 are delivered via the first directing plane 32 and the second directing plane 33 of each directing portion 31 so as to forwardly spread the mists outside.

Figure 2:
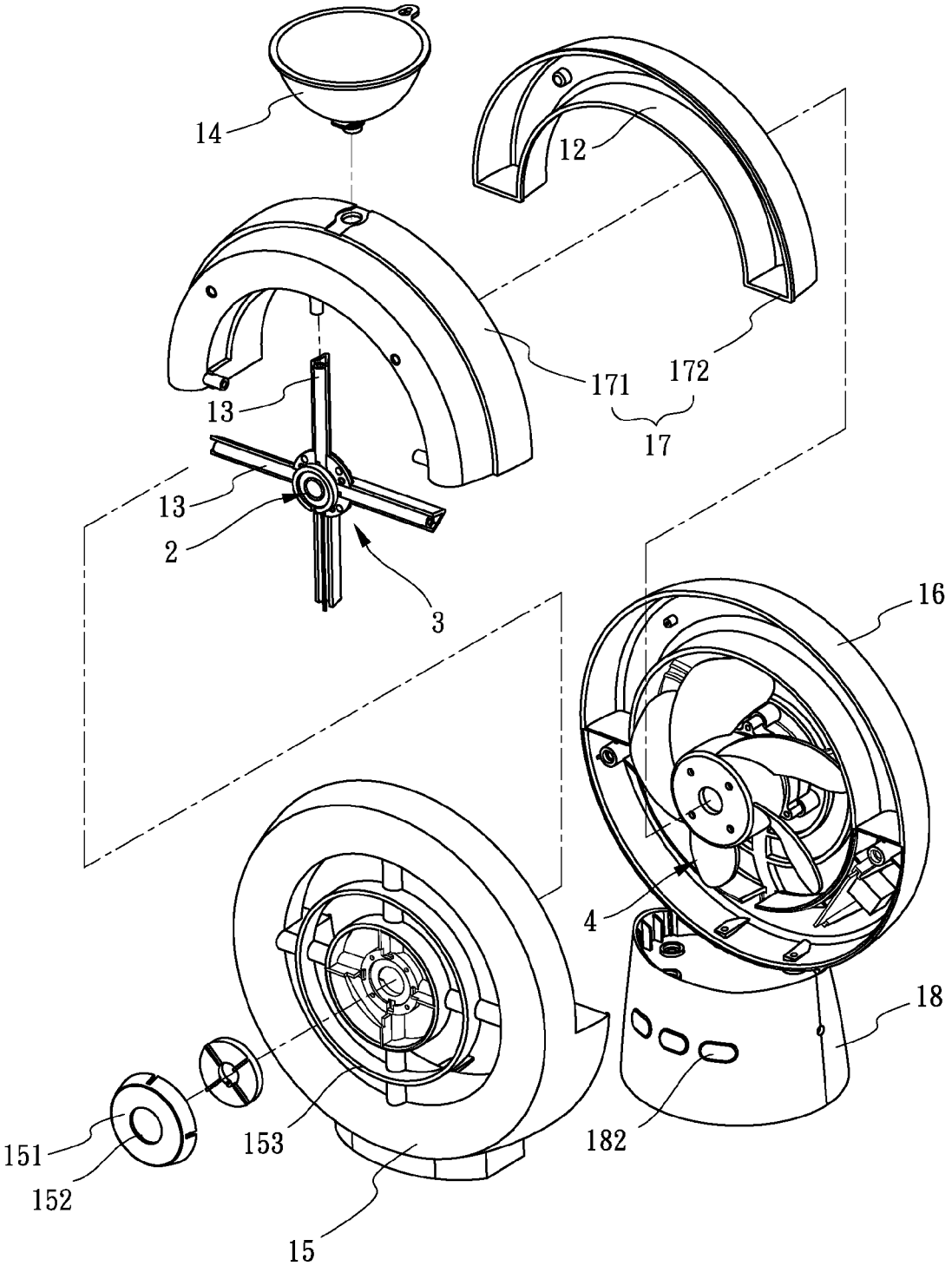
FIG. 2 is a partial exploded view of the misting fan.
Figure 3:
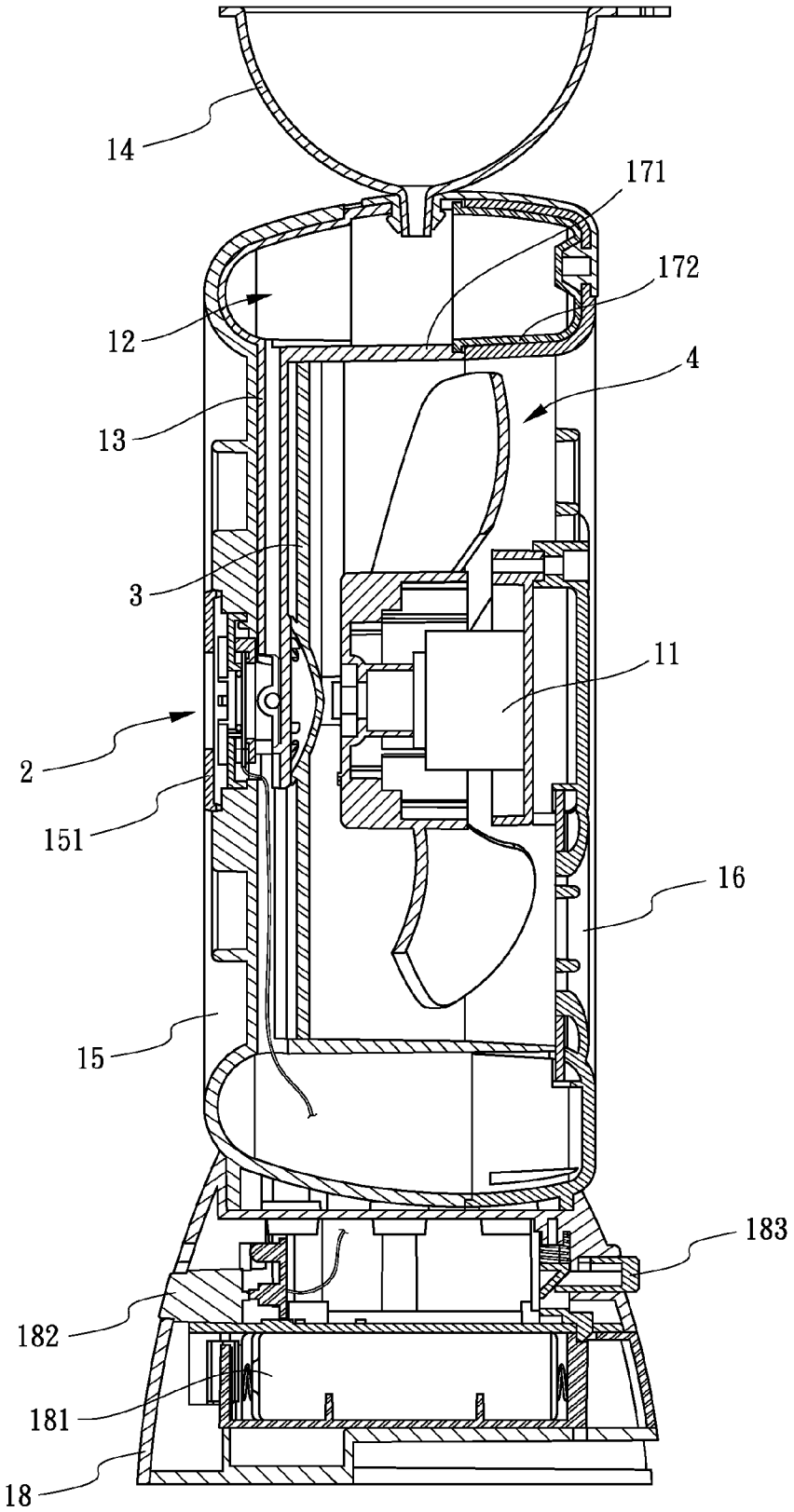
FIG. 3 is a cross-sectional view along line 3'-3' shown in FIG. 1.
Figure 4:
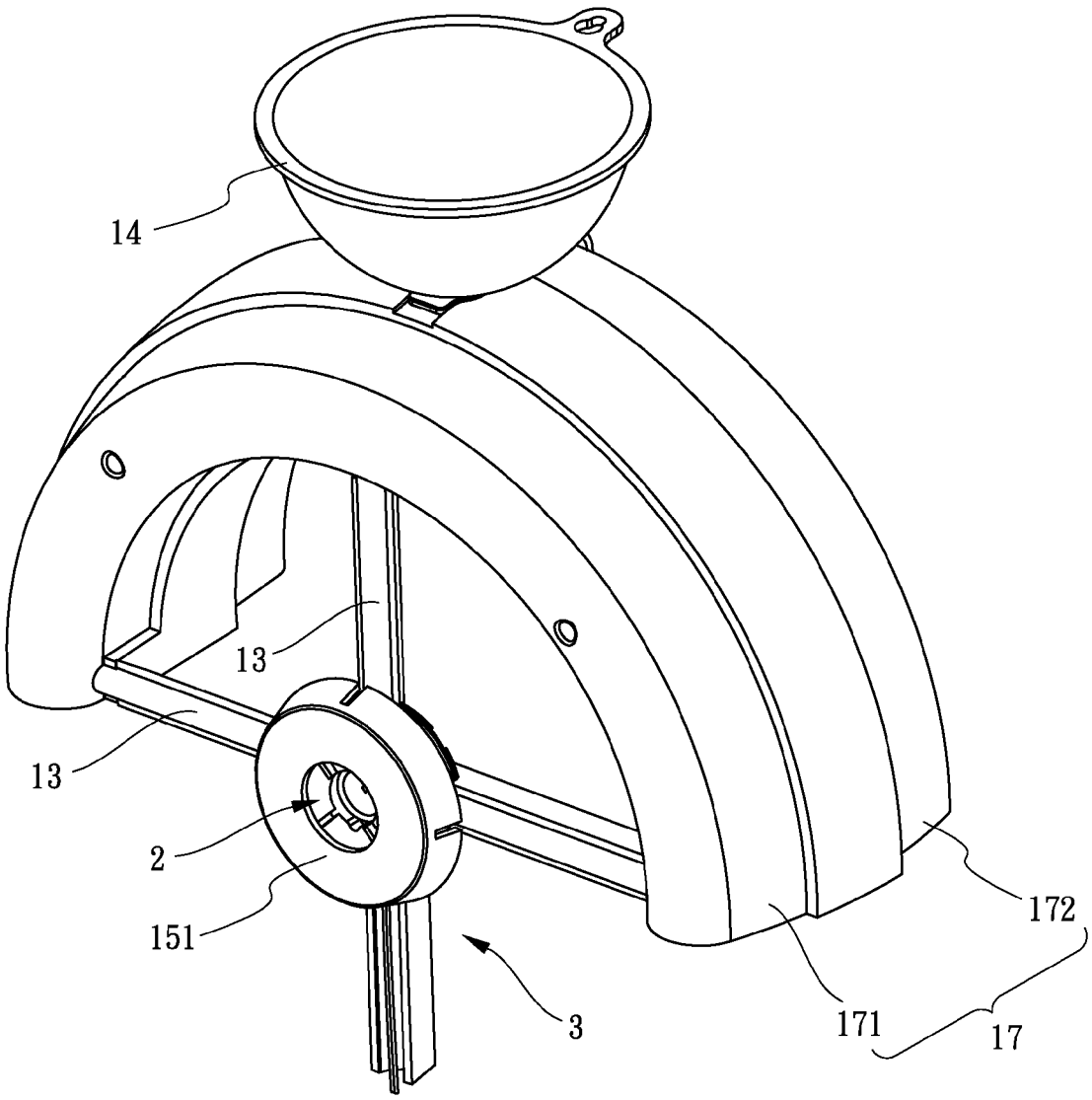
FIG. 4 is a schematic view for showing a tank is assembled to a directing member.

The further details of the present invention are shown as following:

The body 1 has a funnel 14 assembled thereon; the funnel 14 corresponds to an opening of the sink 12. The body 1 comprises an ejecting member 15, an injecting member 16, a tank 17 and a seat 18. A front side of the tank 17 is assembled to the ejecting member 15 and a rear side of the tank 17 is assembled to the injecting member 16 respectively. The tank 17 is defined between an upper portion of the injecting member 16 and another upper portion of the ejecting member 15. A bottom portion of the injecting member 16 and another bottom portion of the ejecting member 15 are assembled to the seat 18. The tank 17 comprises a front casing 171 and a rear casing 172. The front casing 171 is assembled with the rear casing 172. The front casing 171 and the rear casing 172 are both vaulted-shaped as shown in FIGS. 2 and 3. The front casing 171 and the rear casing 172 enclose the sink 12.

In addition, as shown in FIG. 1, the surfaces of injecting member 16 and the ejecting member 15 are both formed as concentric circles with cross extended from a center thereof. The seat 18 has a power supply 181, a plurality of speed tuners 182 and a power switch 183. In a preferred embodiment, the power supply 183 is a battery. The power supply 183 provides electricity for driving the motor 11, the nebulizing member 2, the speed tuners 182 and the power switch 183. The speed tuners 182 control the driving speed of the motor 11. The power switch 183 selectively turns on or turns off the power supply 183 so as to operate and stop the present invention respectively. The motor 11 is assembled to the injecting member 16. The nebulizing member 2 is assembled to the ejecting member 15 and the channels 13 are connected to the ejecting member 15. The directing portion 31 of the directing member 3 partially covers the channels 13. The channels 13 communicate with the tank 17 and the nebulizing member 2, so that a volume of water is delivered from the tank 17 to the nebulizing member 2 because of a difference of potential energies between the tank 17 and the nebulizing member 2.

Figure 6:
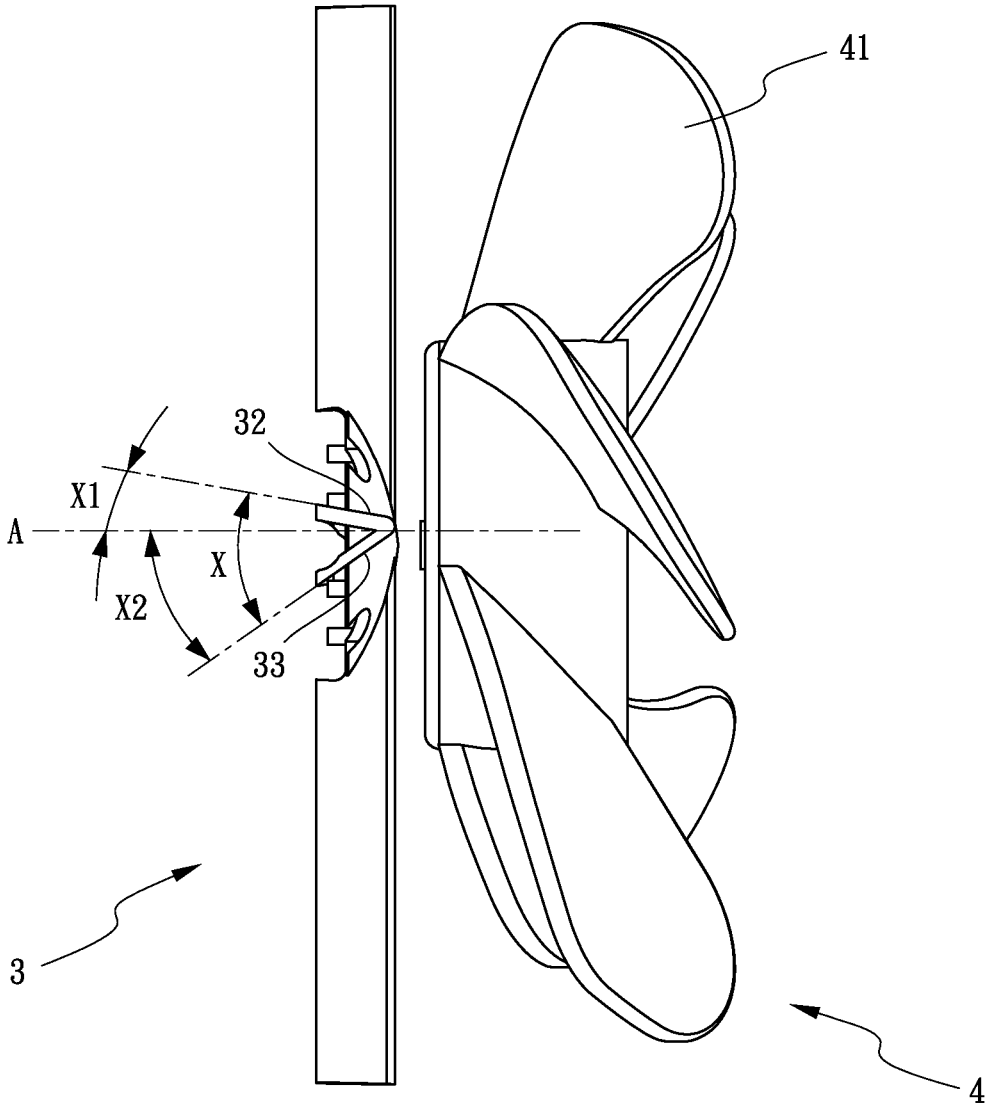
FIG. 6 is a side view for showing the directing member is assembled to a fan member.

Referring to FIG. 5 and FIG. 6, the directing member 3 is cross-shaped. The directing member 3 has four directing portions 31. A cavity portion (not numbered) is formed between the first directing plane 32 and the second directing plane 33 of each directing portion 31 so as to receive the channels 13. Therefore, the gas flows generated by the fan member 4 are directed along the first directing plane 32 and the second directing plane 33 instead of impacting the channels 13 directly.

The first directing plane 32 of each directing portion 31 corresponds to the second directing plane 33 of an adjacent directing portion 31. In a preferred embodiment, one angle X equals to 45 degrees. The directing portion 31 has a horizontal line A. Another angle X1 is defined between the first directing plane 32 of the directing portion 31 and the horizontal line A. In a preferred embodiment, another angle X1 equals to 10 degrees. The other angle X2 which is defined between the second directing plane 33 of the directing portion 31 and the horizontal line A equals to 35 degrees. The gas flows are divided into four parts because of the structure of the directing portions 31. The gas flows are further directed and concentrated by the first directing plane 32 of each directing portion 31 and the second directing plane 33 of the adjacent directing portion 31.

Figure 7:
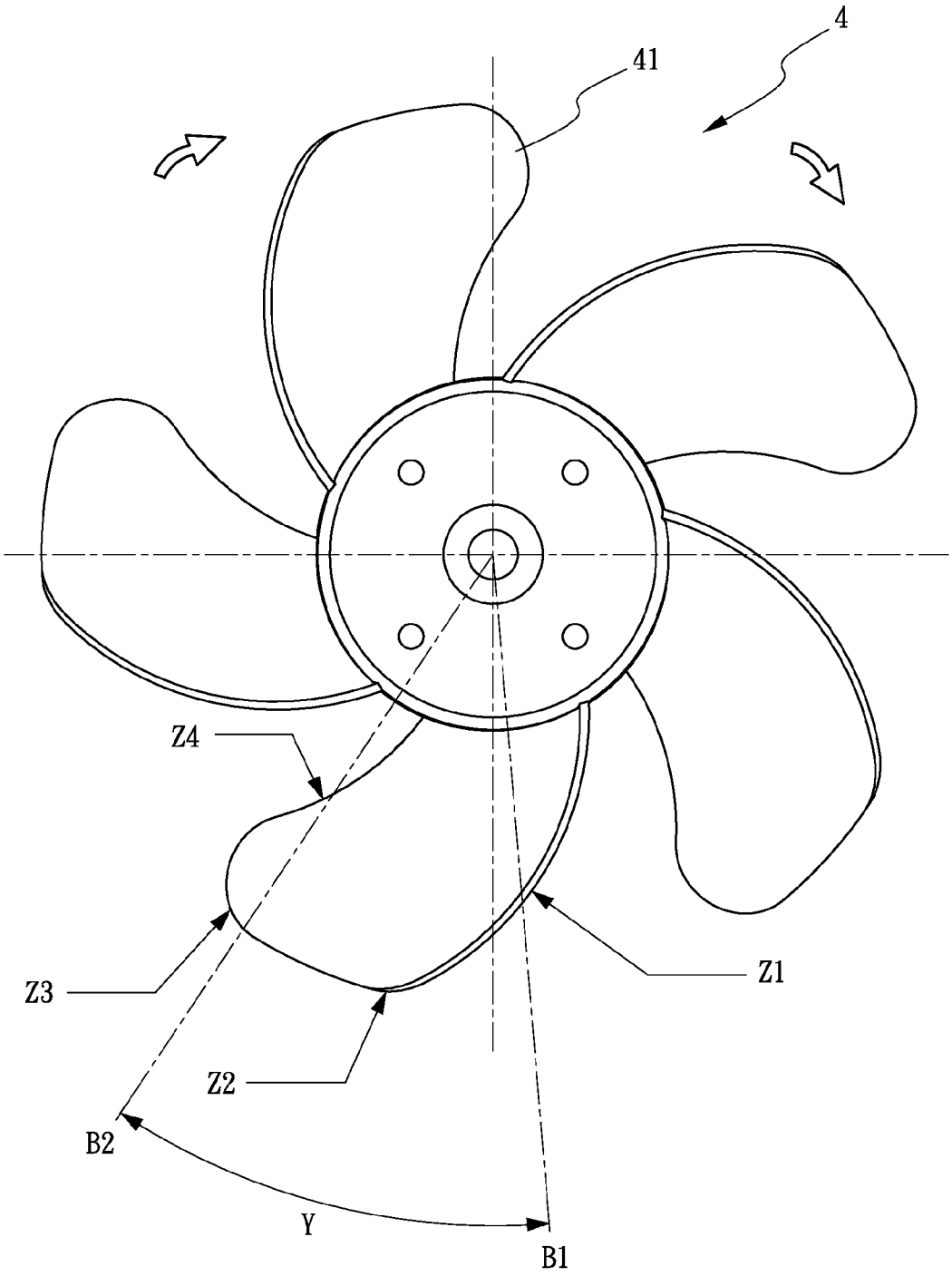
FIG. 7 is a plane projection view of the fan member of the misting fan.
Figure 8:
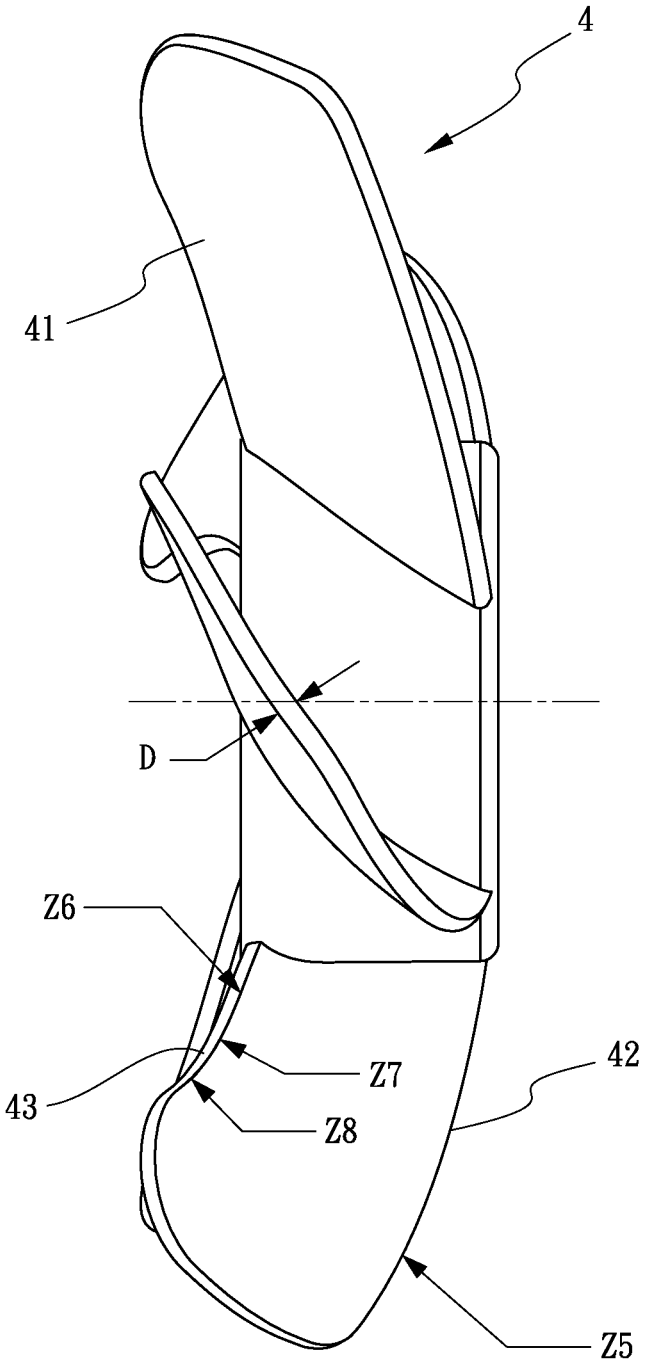
FIG. 8 is a side projection view of the fan member of the misting fan.

Referring to FIG. 7 and FIG. 8, the fan member 4 comprises a plurality of blades 41. In a preferred embodiment, the fan member 4 comprises five blades 41. the fan member 4 has a first axial line B1 and a second axial line B2 extended from a center thereof toward one of the blades 41; an angle of fan member Y defined between the two axial lines B1, B2 is 38.47 degrees; a plane projection of each blade 41 having a first radius Z1, a second radius Z2, a third radius Z3 and a fourth radius Z4, which equal to 36.46 mm, 9.05 mm, 8.65 mm and 32.73 mm respectively. A side projection of each blade 41 has an injecting portion 42 and an ejecting portion 43 defined thereon. The injecting portion 42 has a fifth radius Z5. In a preferred embodiment, the fifth radius Z5 equals to 69.23 mm. The ejecting portion 43 has a sixth radius Z6, a seventh radius Z7 and an eighth radius Z8 which are aligned in order from a center of the blade 41 and equal to 162.48 mm, 31 mm and 12.28 mm respectively. In a preferred embodiment, a blade thickness D is 2 mm. Therefore, the gas flows are further concentrated because of the angle of fan member Y and the size of the blades 41, so that a flying distance of the mists is suitable for the user.

Figure 9:
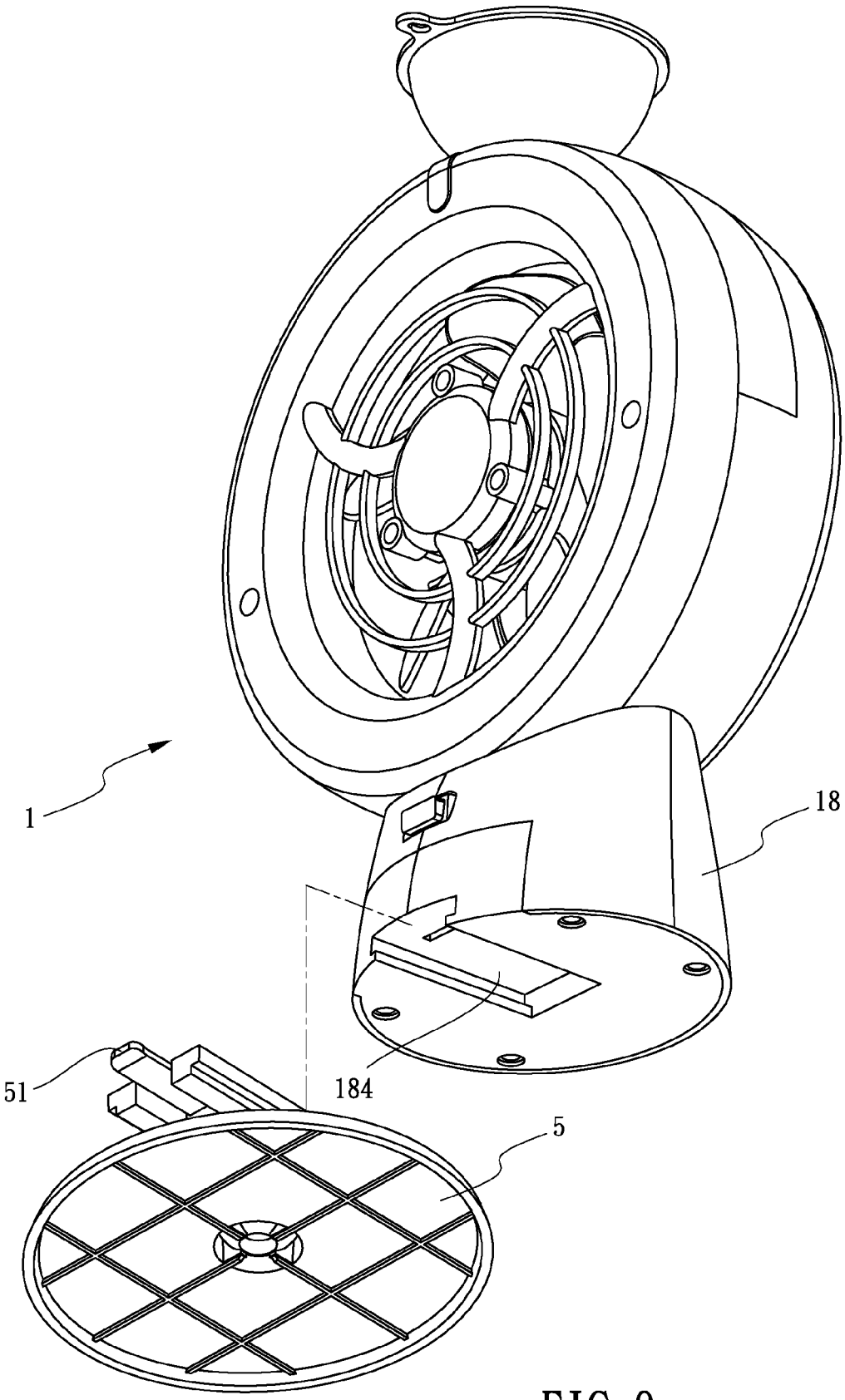
FIG. 9 is a perspective view for showing a base is combinable with a seat of the misting fan.
Figure 10:
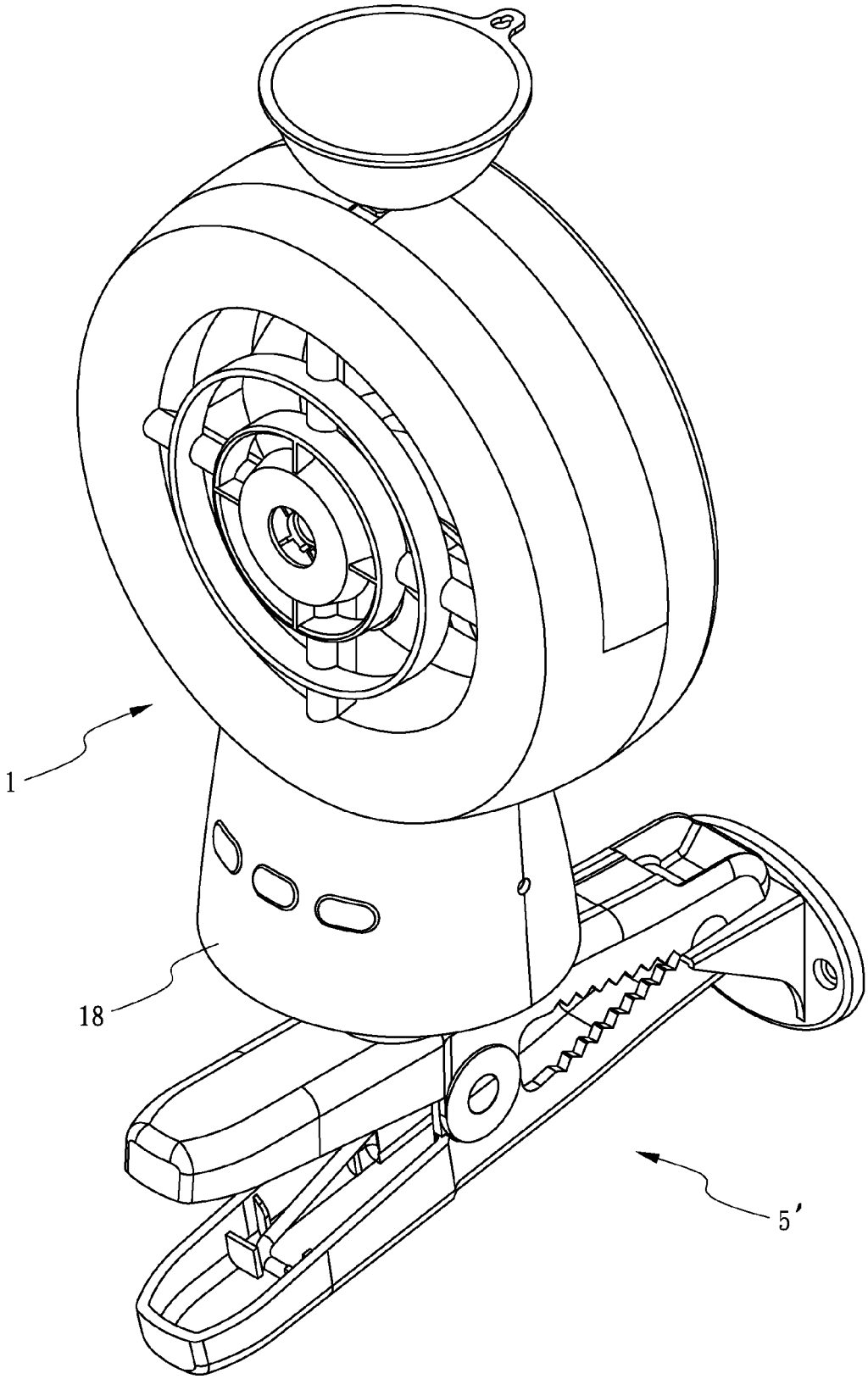
FIG. 10 is a perspective view for showing the seat of the misting fan is combinable with a clamp.
Figure 11:
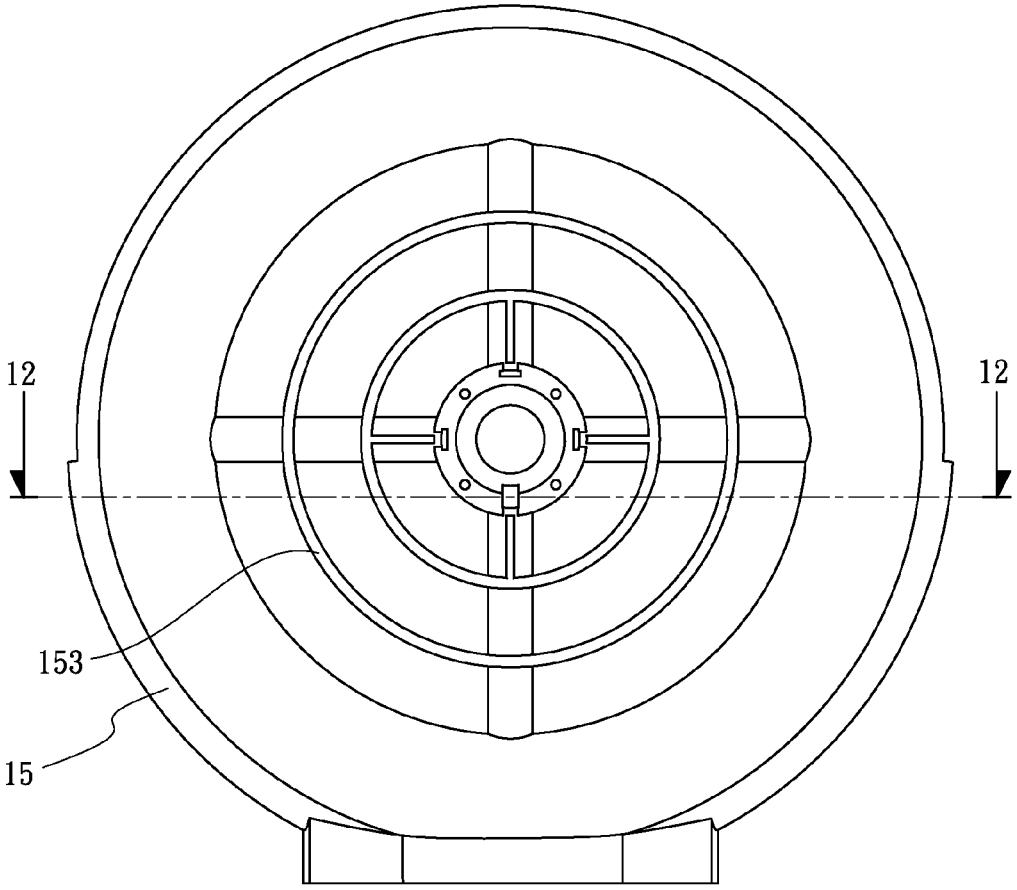
FIG. 11 is a schematic view of an ejecting member of the misting fan.
Figure 12:
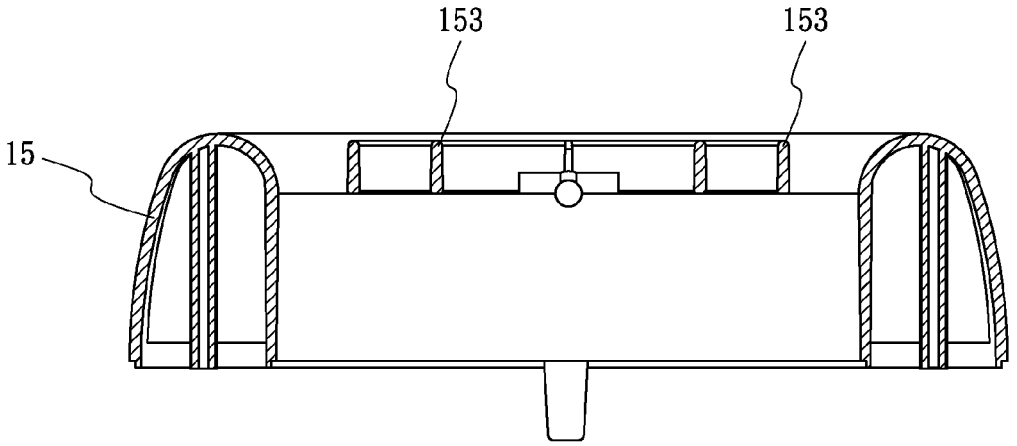
FIG. 12 is a cross-sectional view along line 12-12 shown in FIG. 11.

Referring to FIG. 9, the seat 18 has an assembling groove 184 defined at a bottom thereof. The body 1 further comprises a base 5 which is assembled to the assembling groove 184. The base 5 has an assembling portion 51 defined thereon. The base 5 is round plate shaped so as to place on a surface of ground, a desk or a closet. Moreover, referring to FIG. 10, the base 5 is also applicable to be a clamp 5', so that the present invention is fastened on a rod or a plate structure.

In addition, as shown in FIG. 2, the ejecting member 15 has a cap 151 assembled thereon. The cap 151 has an outlet 152 opened thereon. The outlet 152 corresponds to the nebulizing member 2 so that the mists of the nebulizing member 2 are spread outwardly from the outlet 152. Therefore, a size of the mists is small enough to be ejected forwardly so as to reach the flying distance.

Furthermore, the ejecting member 15 has a plurality of annular ribs 153 defined thereon. The annular ribs 153 enclose the cap 151. A thickness of each annular rib 153 is gradually decreased from the injecting member 16 toward the ejecting member 15. Therefore, the annular ribs 153 direct the gas flows to be ejected forwardly.

All in all, the present invention has several advantages as following.

Firstly, the gas flows are directed and concentrated because of the first directing planes 32, the second directing planes 33, the angle of fan member Y, the size of the blades 41, so that a flying distance of the mists is suitable for the user.

Secondly, installing the present invention is relatively easy and time saving as compared to the prior arts.

Thirdly, since a volume of water is delivered from the tank 17 to the nebulizing member 2 by the difference of potential energies between the tank 17 and the nebulizing member 2, no extra energy are required to drive a pump for pumping the water to the nebulizing member 2.

Although the invention has been explained in relation to its preferred embodiment, it is to be understood that many other possible modifications and variations can be made without departing from the spirit and scope of the invention as hereinafter claimed.

What is claimed is:

1. A misting fan comprising:

a body, a nebulizing member, a directing member and a fan member;

the body having a motor assembled therein, the body having a sink and a plurality of channels defined at an upper portion thereof, the channels communicating with the sink;

the nebulizing member being assembled on the body, the nebulizing member corresponding to one side of the motor and communicating with the channels;

the fan member being assembled to the motor, the fan member being defined between the nebulizing member and the motor; and the directing member being assembled on the body, the directing member being defined between the fan member and the nebulizing member, the directing member corresponding to a direction of gas flows generated by the rotation of the fan member, the directing member comprising a plurality of directing portions, each directing portion comprising a first directing plane and a second directing plane, a first angle being defined between each first directing plane and each corresponding second directing plane, each first directing plane and each corresponding second directing plane corresponding to the fan member;

wherein when a volume of water is delivered from the sink to the nebulizing member via the channels so as to eject mists, the gas flows generated by the rotation of the fan member are delivered via the first directing plane and the second directing plane of each directing portion so as to forwardly spread the mists outside; and wherein the body comprises an ejecting member, an injecting member, a tank and a seat; a front side of the tank is assembled to the ejecting member and a rear side of the tank is assembled to the injecting member respectively; the tank is defined between an upper portion of the injecting member and another upper portion of the ejecting member; a bottom portion of the injecting member and another bottom portion of the ejecting member are assembled to the seat; the motor is assembled to the injecting member; the nebulizing member and the channels are assembled to the ejecting member; the directing portion of the directing member partially covers the channels.

2. The misting fan as claimed in claim 1, wherein the fan member comprises a plurality of blades; the fan member has a first axial line and a second axial line extended from a center thereof toward one of the blades; an angle of fan member defined between the two axial lines is 38.47 degrees; a plane projection of each blade has a first radius, a second radius, a third radius and a fourth radius, which equal to 36.46 mm, 9.05 mm, 8.65 mm and 32.73 mm respectively.

3. The misting fan as claimed in claim 2, wherein a side projection of each blade has an injecting portion and an ejecting portion defined thereon; the injecting portion has a fifth radius which equals to 69.23 mm; the ejecting portion has a sixth radius, a seventh radius and an eighth radius which are aligned in order from a center of the blade and equal to 162.48 mm, 31 mm and 12.28 mm respectively; a blade thickness is 2 mm.

4. The misting fan as claimed in claim 1, wherein the first directing plane of each directing portion corresponds to the second directing plane of an adjacent directing portion; one angle defined between the first directing plane and the second directing plane of each directing portion equals to 45 degrees.

5. The misting fan as claimed in claim 4, wherein the directing portion has a horizontal line; another angle between the first directing plane of the directing portion and the horizontal line equals to 10 degrees; the other angle between the second directing plane of the directing portion and the horizontal line equals to 35 degrees.

6. The misting fan as claimed in claim 1, wherein the body has a funnel assembled thereon; the funnel corresponds to an opening of the sink.

7. The misting fan as claimed in claim 1, wherein the tank comprises a front casing and a rear casing; the front casing is assembled with the rear casing; the front casing and the rear casing are both vaulted-shaped; the front casing and the rear casing enclose the sink.

8. The misting fan as claimed in claim 1, wherein the seat has an assembling groove defined at a bottom thereof; the body further comprises a base which is assembled to the assembling groove.

9. The misting fan as claimed in claim 1, wherein the ejecting member has a cap assembled thereon; the cap has an outlet opened thereon; the outlet corresponds to the nebulizing member so that the mists of the nebulizing member are spread outwardly from the outlet; the ejecting member has a plurality of annular ribs defined thereon; the annular ribs enclose the cap; a thickness of each annular rib is gradually decreased from the injecting member toward the ejecting member.

* * * * *